US009713933B2

(12) United States Patent
Umeda

(10) Patent No.: US 9,713,933 B2
(45) Date of Patent: Jul. 25, 2017

(54) SHEET POST-PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Keita Umeda, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 181 days.

(21) Appl. No.: 14/687,782

(22) Filed: Apr. 15, 2015

(65) Prior Publication Data

US 2016/0303886 A1 Oct. 20, 2016

(51) Int. Cl.

| | |
|---|---|
| ***B42C 9/00*** | (2006.01) |
| ***B65H 37/04*** | (2006.01) |
| ***B65H 43/00*** | (2006.01) |
| ***B65H 37/02*** | (2006.01) |
| ***B42C 1/12*** | (2006.01) |
| ***B42C 19/02*** | (2006.01) |

(52) U.S. Cl.

CPC ..... *B42C 9/0081* (2013.01); *B42C 1/125* (2013.01); *B42C 19/02* (2013.01); *B65H 37/02* (2013.01); *B65H 37/04* (2013.01); *B65H 43/00* (2013.01)

(58) Field of Classification Search

CPC ..... B42C 1/125; B42C 9/0081; B42C 19/02; B65H 37/02; B65H 37/04; B65H 43/00

USPC ..... 270/58.07, 58.08, 58.09

See application file for complete search history.

(56) References Cited

U.S. PATENT DOCUMENTS

| | | | | |
|---|---|---|---|---|
| 5,320,335 | A * | 6/1994 | Iwata | B42B 4/00 270/52.02 |
| 6,308,041 | B2 * | 10/2001 | Shiramura | 347/129 |
| 7,413,177 | B2 * | 8/2008 | Mori | B65H 39/11 270/58.04 |
| 7,497,427 | B2 * | 3/2009 | Ogushi | B42C 1/12 270/37 |
| 7,931,262 | B2 * | 4/2011 | Ochi | G03G 15/6538 270/37 |
| 8,074,976 | B2 * | 12/2011 | Ochi | G03G 15/50 270/52.18 |

(Continued)

FOREIGN PATENT DOCUMENTS

| | | |
|---|---|---|
| JP | 2009-202485 | 9/2009 |

OTHER PUBLICATIONS

U.S. Appl. No. 14/619,366, filed Feb. 11, 2015, Inventor: Hiroyuki Taki.

*Primary Examiner* — Leslie A Nicholson, III

(74) *Attorney, Agent, or Firm* — Patterson & Sheridan, LLP

(57) ABSTRACT

A post-processing apparatus according to an embodiment includes an adhesive binding unit that binds a plurality of sheets into a bundle. A controller sets an allowable binding number X of sheets capable of being subject to binding at one time in the adhesive binding apparatus. The controller sets a predetermined remaining number N of sheets. The controller receives a number A of the sheets instructed to be bound in the adhesive binding unit. The controller calculates a remaining number n of sheets, where n=A−X. The controller determines whether n>N or n≤N. The adhesive binding unit binds the A number of the sheets into a single bundle when it is determined that n≤N.

18 Claims, 10 Drawing Sheets

(56) References Cited

U.S. PATENT DOCUMENTS

| | | | | |
|---|---|---|---|---|
| 8,177,214 | B2 * | 5/2012 | Sato | B42B 4/00 270/52.18 |
| 2011/0135366 | A1 * | 6/2011 | Asai | B42C 19/02 399/408 |
| 2013/0328258 | A1 * | 12/2013 | Mutsuno | B42B 4/00 270/1.01 |
| 2015/0023765 | A1 * | 1/2015 | Hongu | B65H 43/06 412/33 |
| 2015/0063953 | A1 | 3/2015 | Taguchi et al. | |

* cited by examiner

SHEET POST-PROCESSING APPARATUS

FIELD

Embodiments described herein relate generally to a technique for producing a sheet bundle by applying adhesive to sheets continuously fed one by one.

BACKGROUND

In the related art, a sheet post-processing apparatus is provided in which sheets discharged from an image forming apparatus body are sequentially received, the sheets are discharged and stacked on a processing tray, and a sheet bundle is bound. Then, the sheet post-processing apparatus includes a adhesive application mechanism in which adhesive is applied to a portion corresponding to a predetermined binding margin of the sheet. An operation for loading the sheets on a adhesive application portion is sequentially repeated. A plurality of sheets are thereby produced in a bundle.

However, the maximum number of sheets that can be bound at one time by the adhesive application mechanism is limited. Thus, there is a problem that it is not possible to set the sheets exceeding the predetermined number in the adhesive application mechanism.

DETAILED DESCRIPTION

A post-processing apparatus according to an embodiment includes an adhesive binding unit that binds a plurality of sheets into a bundle. A controller sets an allowable binding number X of sheets capable of being subject to binding at one time in the adhesive binding apparatus. The controller sets a predetermined remaining number N of sheets. The controller receives a number A of the sheets instructed to be bound in the adhesive binding unit. The controller calculates a remaining number n of sheets, where $n=A-X$. The controller determines whether $n>N$ or $n\leq N$. The adhesive binding unit binds the A number of the sheets into a single bundle when it is determined that $n\leq N$.

Hereinafter, a sheet binding apparatus according to an embodiment and a post-processing apparatus (so-called finisher) including the sheet binding apparatus will be described in detail with reference to the drawings.

Figure 1:
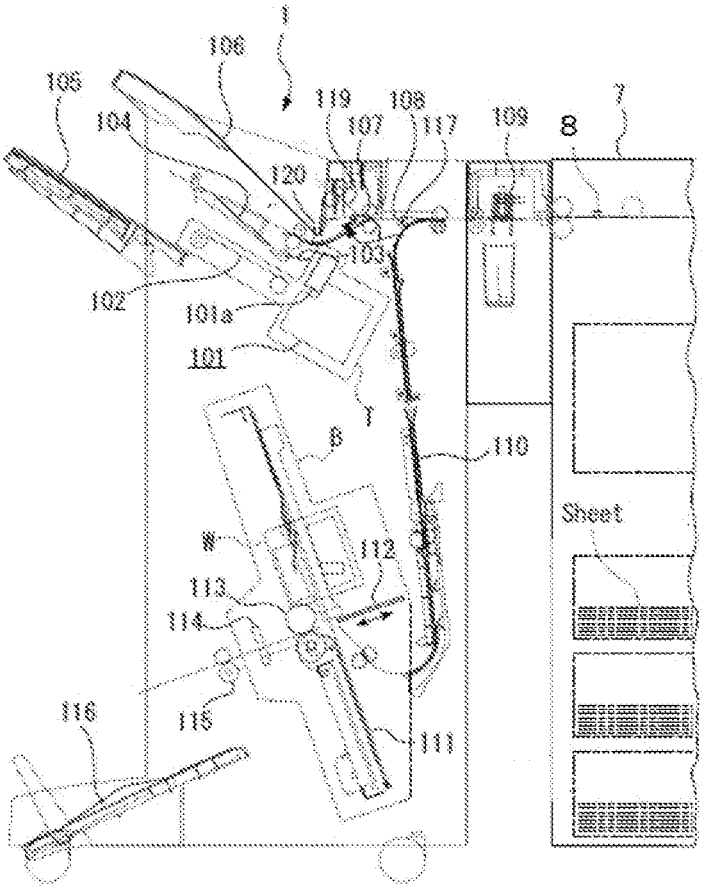
FIG. 1 is a schematic illustration of a post-processing apparatus according to an embodiment.
Figure 2:
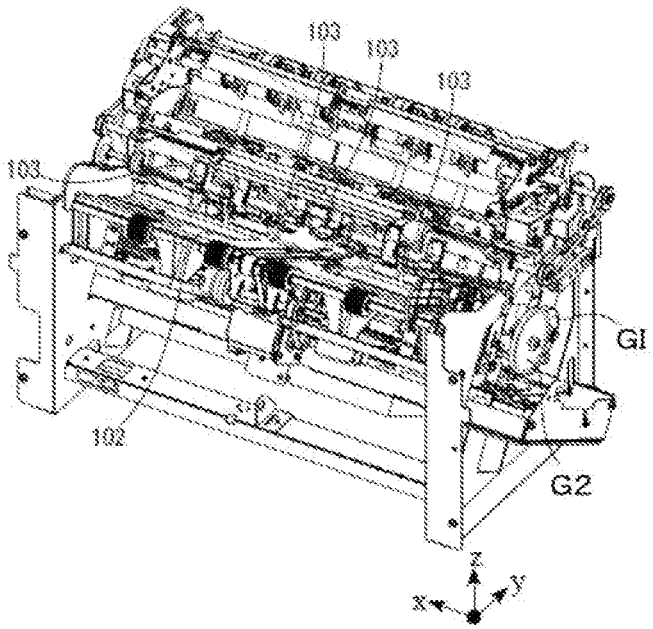
FIG. 2 is a perspective view illustrating an adhesive binding process unit viewed from a processing tray side.
Figure 3:
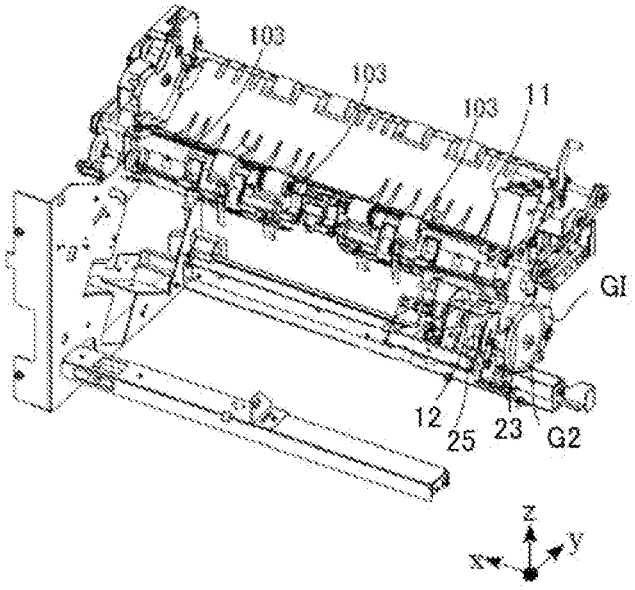
FIG. 3 is a perspective view illustrating the adhesive binding process unit with periphery members removed.

FIG. 1 is a schematic view illustrating a post-processing apparatus 1. For example, the post-processing apparatus 1 according to the embodiment receives a sheet discharged from an image forming apparatus 7 connected to the post-processing apparatus 1. The post-processing apparatus 1 performs various processes such as binding, folding, and drilling with respect to the sheets. FIG. 2 is a perspective view illustrating an adhesive binding process unit viewed from a processing tray side and FIG. 3 is a perspective view illustrating the adhesive binding process with periphery members removed.

The post-processing apparatus 1 includes, for example, a binding unit T, a folding unit B, a stapler W, a punching unit 109, and the like for performing post-processing functions. Here, as an example, the configuration of the post-processing apparatus 1 includes the binding unit T, the folding unit B, the stapler W, the punching unit 109, and the like. The post-processing apparatus 1 is not limited to the example, but includes at least the binding unit T.

First, the sheet on which an image is formed in the image forming apparatus 7 passes through the punching unit 109. When hole punching is to be performed with respect to the sheet, the hole punching is performed to the sheet by the punching unit 109 at this time point.

A transporting destination of the sheet passed through the punching unit 109 is switched to one of a transportation path 110 and a transportation path 108 by a flapper 117.

If only the hole punching is desired to be performed with respect to the sheet, or if the sheet passed through the punching unit 109 is desired to be discharged to the outside of the apparatus without change, the sheet is guided to the transportation path 108 by the flapper 117 and is further guided to a transportation path 119 by a flapper 107, and then is discharged to a first discharge tray 106.

Meanwhile, if binding with respect to the sheet is desired to be performed by the binding unit T, the sheet guided to the transportation path 108 is further guided to a transportation path 120 by the flapper 107 and is discharged on a temporary tray 104 (so-called buffer tray).

Thereafter, the sheet discharged on the temporary tray 104 is knocked off by a rotating paddle 103 rotating counterclockwise on a paper surface of FIG. 1 and is stacked on a processing tray 102.

The binding unit T includes a adhesive application unit 101 that performs adhesive application on an upper surface of the sheet stacked on the processing tray 102. The binding unit T performs the adhesive application on the upper surface of the sheet with the adhesive application unit 101 whenever the sheet is stacked on the processing tray 102. However, for example, if a sheet bundle of 10 sheets being bound, adhesive application is not performed on an upper surface of the tenth sheet (the uppermost sheet stacked on the ninth sheet).

The adhesive application unit 101 includes an adhesive applying unit U that is removably stored in a holder 11. A pressing force receiving stand 12 is disposed below the holder 11. The holder 11 is movably held in a guide shaft 13 and can move in an axial direction. When the holder 11 is positioned in a standby position to which the holder 11 moves upward from the pressing force receiving stand 12 in the axial direction by a distance H, the distance H corresponds to the number of sheets that is bound at one time. In order to apply a pressing force after the adhesive application, a pressing plate 14 is disposed between a lower end of the holder 11 and the uppermost surface of the sheet bundle stacked on the pressing force receiving stand 12. Thus, the maximum height (maximum number of sheets) of the sheet bundle becomes a height (h) which is smaller than a height H, considering an arrangement space of the pressing plate 14 or the like. The binding number of sheets corresponding to the height (hereinafter, referred to as a binding limit height) h is the allowable binding number (X) of sheets.

However, the number of sheets corresponding to the binding limit height h is different depending on the thickness of the sheets. Furthermore, a thickness of the adhesive used for the adhesive binding is not necessarily constant. Thus, in the embodiment, the allowable binding number (X) of sheets corresponding to the binding limit height h is set to be a small number of sheets and the binding is performed with a certain degree of allowance.

Thus, even if the binding number of sheets exceeds the allowable binding number (X) of sheets, the height thereof practically may be the binding limit height h or less, even with the exceeded number of sheets. Thus, the number of sheets in which the predetermined number (N) of sheets is added to the allowable binding number (X) of sheets practically corresponds to the binding limit height h. Thus, even if the number (A) of sheets instructed to be printed exceeds the allowable binding number (X) of sheets, when the exceeded number of sheets (the remaining number (n) of sheets described below) is smaller than the predetermined number (N) of sheets (predetermined remaining number of sheets), the sheets are bound as one bundle.

Upper and lower holder arms 15 and 16 of the holder 11 are slidably inserted into the guide shaft 13 in the axial direction. Furthermore, first and second pressing springs 17A and 17B—which may be tension springs, for example—are respectively disposed between right and left side surfaces of the holder 11 and a adhesive application unit substrate (not illustrated), and function to bias the holder 11 towards the pressing force receiving stand 12.

Figure 7:
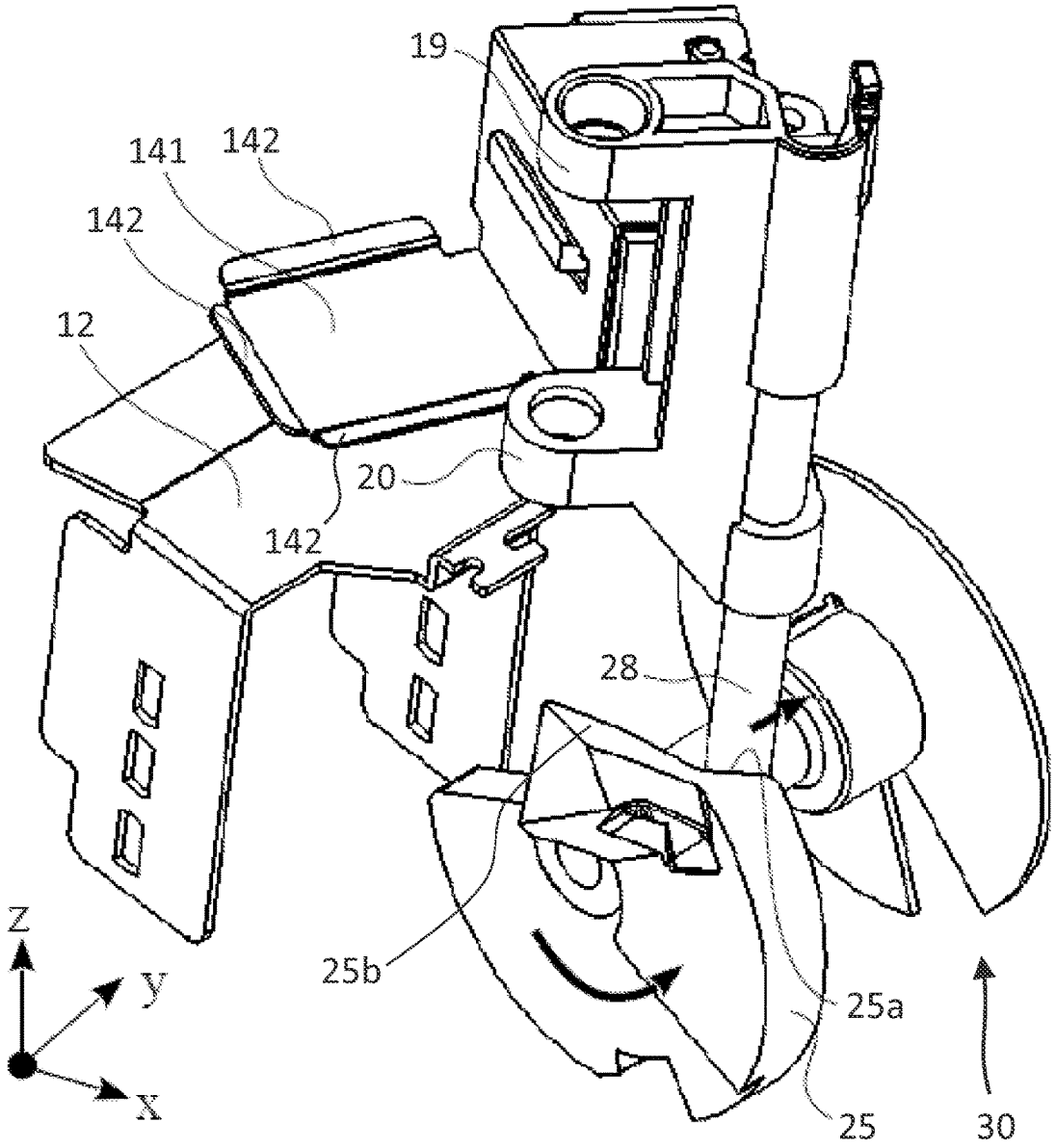
FIG. 7 is a perspective view illustrating a shutter member of the adhesive binding unit.

As illustrated in FIG. 7, the pressing plate 14 is formed with a concaved vertically cross-sectional shape in which flanges 142 rise upward from three sides of a rectangular plate-shaped bottom plate 141. A lower end of the holder 11 abuts upper surfaces of the flanges 142 so that an adhesive applying surface of the adhesive applying unit U does not directly abut the bottom plate 141.

The adhesive applying unit U is the adhesive applying unit which causes the adhesive as adhesive for bonding the sheets each other to be applied to the sheet. Specifically, as the adhesive applying unit, it is possible to employ a system in which the adhesive is applied by abutting mesh impregnated with liquid adhesive and the like.

An adhesive binding position of the sheet mounted on the processing tray 102 is mounted on the pressing force receiving stand 12 in a state of abutting an abutting alignment position. Thus, the adhesive applying unit U applies the adhesive to a predetermined region of the upper surface of the sheet when being pressed by the spring forces of the first and second pressing springs 17A and 17B.

When the holder 11 moves up and down for applying the adhesive, the pressing plate 14 is held in a position retracted from the pressing force receiving stand 12. The pressing plate 14 is mounted on a pressing plate holding body 18. The pressing plate holding body 18 is fixed to rotation arms 19 and 20 disposed on upper and lower sides. The rotation arms 19 and 20 are mounted on the guide shaft 13 and can move in the axial direction and rotatably about the shaft. The upper holder arm 15 is disposed above the upper rotation arm 19. The upper rotation arm 19 is disposed above the lower holder arm 16. The lower rotation arm 20 is disposed below the lower holder arm 16.

Thus, the pressing plate holding body 18 moves up and down following the up and down movement of the holder 11. Furthermore, the pressing plate 14 is capable of turning about the guide shaft 13 between a pressing position immediately above the pressing force receiving stand 12 and a non-pressing position retracted from the pressing force receiving stand 12.

A turning spring 21—which may be a tension spring, for example—is disposed between the pressing plate holding body 18 and a adhesive application unit substrate (not illustrated), and biases the pressing plate 14 towards the non-pressing position.

A turning drive unit drives the pressing plate 14 to be turned against the spring force of the turning spring 21. An up-down drive unit moves the holder 11 up and down against the spring forces of the first and second pressing springs 17A and 17B. The turning drive unit and the up-down drive unit may be configured to be driven by separate motors, however, in the embodiment, the up-down drive unit and the turning drive unit are configured to be driven by one motor M.

Figure 4:
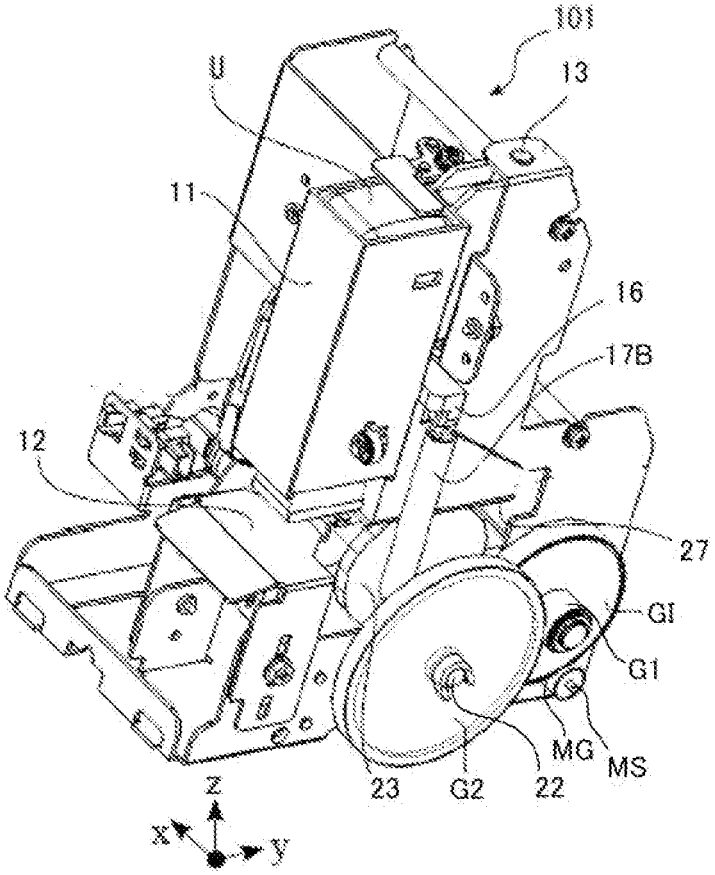
FIG. 4 is another perspective view illustrating the adhesive binding process unit.
Figure 5:
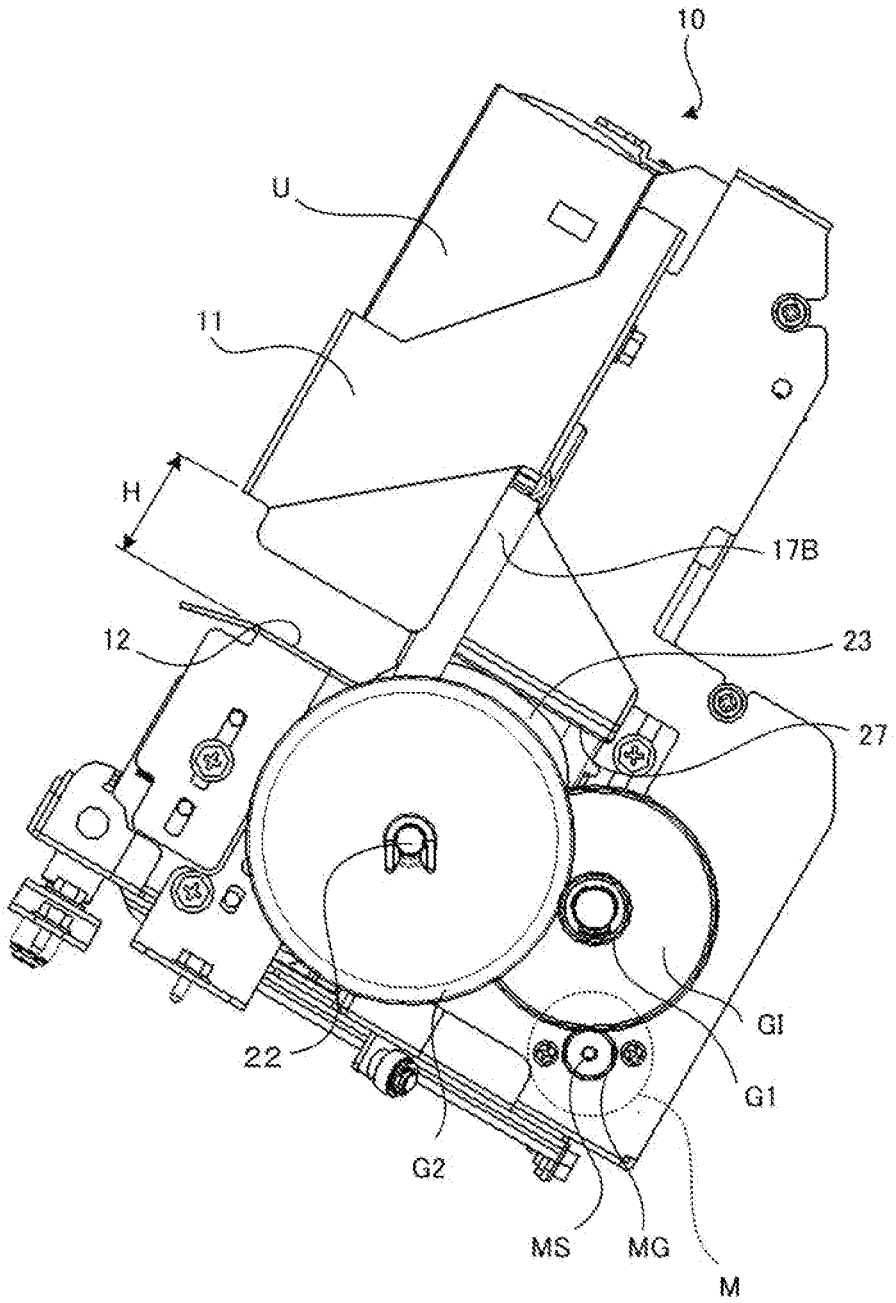
FIG. 5 is a front view illustrating the adhesive binding unit.
Figure 6:
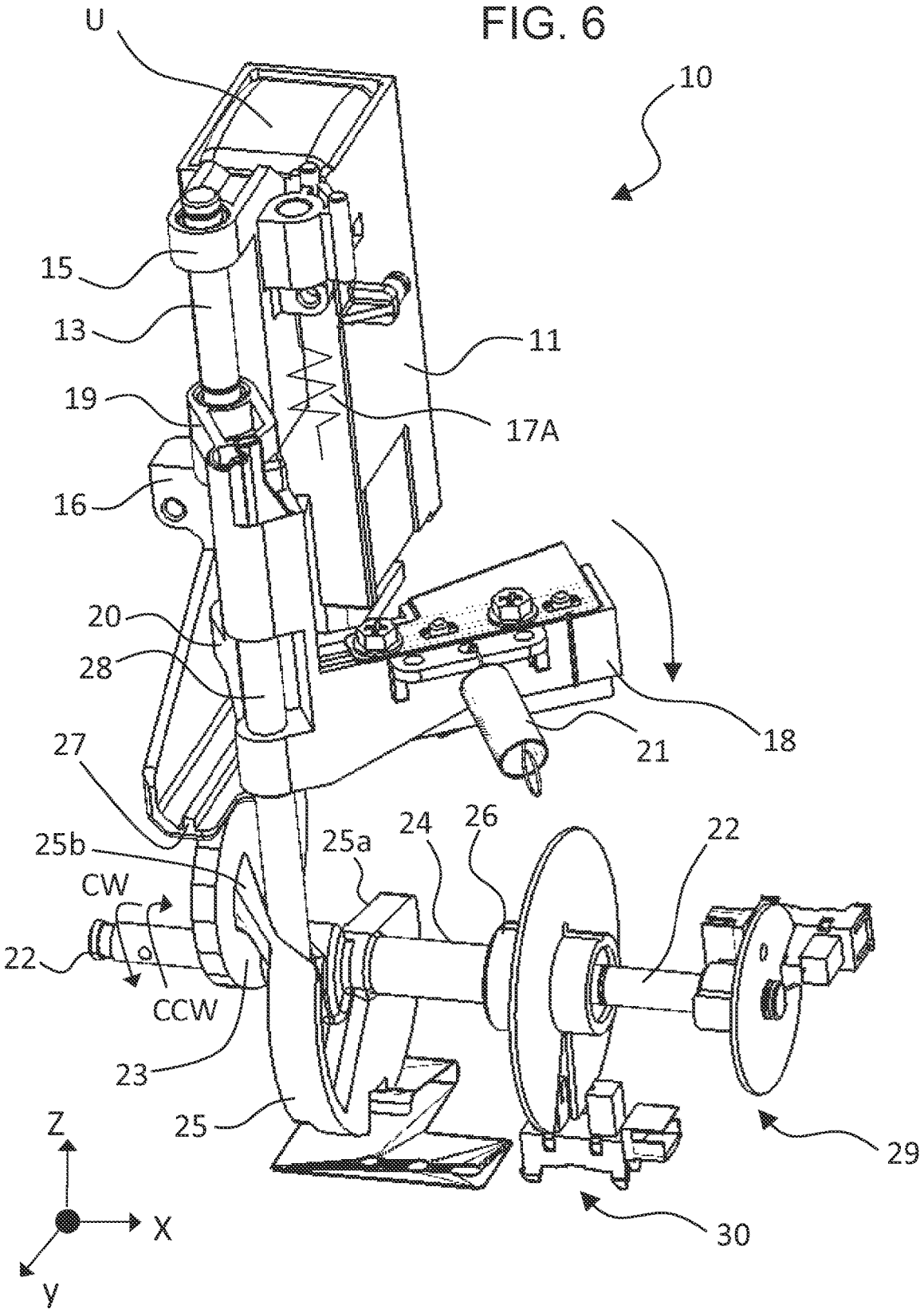
FIG. 6 is a perspective view illustrating a driving mechanism of the adhesive binding unit.

In FIGS. 4 to 6, a motor gear MG is mounted on a motor shaft MS of the motor M. The motor gear MG is meshed with an intermediate gear GI. A first transmission gear G1 having a coaxial small diameter is mounted on the intermediate gear GI. The first transmission gear G1 is meshed with a second transmission gear G2 having a large diameter. The second transmission gear G2 is mounted on a first rotation shaft 22.

The up-down drive unit includes a disk-shaped first cam 23 fixed to the first rotation shaft 22. A second rotation shaft 24 is coaxially mounted on the first rotation shaft 22 from outside. The turning drive unit includes a second cam 25 fixed to the second rotation shaft 24.

The first rotation shaft 22 and the second rotation shaft 24 are connected through a one-way clutch 26. When the first rotation shaft 22 rotates counterclockwise (CCW), the one-way clutch 26 transmits a rotational force to the second rotation shaft 24 and integrally rotates the first rotation shaft 22 and the second rotation shaft 24 counterclockwise. Meanwhile, when the first rotation shaft 22 rotates clockwise (CW), the one-way clutch 26 does not transmit the rotational force to the second rotation shaft 24 and only rotates the first rotation shaft 22 clockwise.

A plate-shaped lifting cam follower 27 abuts a cam surface of the first cam 23 and is mounted on a lower portion of the holder 11. A rod-shaped turning cam follower 28 engages the cam surface of the second cam 25 and is passed through and fixed to base sides of the rotation arms 19 and 20.

In the embodiment, when the holder 11 moves up and down and the pressing plate 14 is held in the non-pressing position (illustrated in FIG. 6) to perform the adhesive application, the motor M is controlled so that the first rotation shaft 22 rotates clockwise. When pressing the sheet bundle to which the adhesive application is performed, the motor M is controlled so that the first rotation shaft 22 rotates counterclockwise.

A cam top position (corresponding to the retracted position of the holder 11) of the first cam 23 is detected by a first phase sensor unit 29 provided in a leading end portion of the first rotation shaft 22. An engagement start position (corresponding to the non-pressing position) of the second cam 25 with the turning cam follower 28 is detected by a second phase sensor unit 30 provided in a leading end portion of the second rotation shaft 24.

For example, the first cam 23 may be configured with a true circular-shaped disk mounted on and eccentric relative to the first rotation shaft 22. In the state illustrated in FIG. 6, the holder 11 is held in a standby position and the first phase sensor unit 29 outputs an ON signal indicating the standby position. When the first rotation shaft 22 starts to rotate, the output of the first phase sensor unit 29 is switched to OFF and when the first rotation shaft 22 rotates one round, the output is switched to the ON signal.

In the second cam 25, a cut-out portion 25*a* is formed in a part of a substantially disk-shaped member. The state illustrated in FIG. 6 indicates the non-pressing position in which the rod-shaped turning cam follower 28 is fitted into the cut-out portion 25*a* and is engaged with one end surface of the cut-out portion 25*a*. An extension portion 25*b* extending to the first cam 23 side is formed in one end surface of the cut-out portion 25*a*. When the second cam 25 rotates counterclockwise from the state illustrated in FIG. 6, the turning cam follower 28 starts to turn about the guide shaft 13 clockwise while engaging with one end of the cut-out portion 25*a*. At the same time, the turning cam follower 28 moves downward while following downward moving of the holder 11. When the second cam 25 further rotates clockwise, the turning cam follower 28 is switched to the engagement with the extension portion 25*b* and the pressing plate 14 reaches the pressing position. When the pressing plate 14 reaches the pressing position, the turning cam follower 28 is released from the engagement with the second cam 25.

In the engagement released state, the pressing plate 14 receives the spring force of the turning spring 21. However, the pressing plate 14 is interposed between the lower end of the holder 11 and the upper surface of the sheet bundle. After the first rotation shaft 22 rotates half-way around, the holder 11 starts to move upward against the spring forces of the first and second pressing springs 17A and 17B and the pressing plate 14 starts to turn counterclockwise. Furthermore, the turning cam follower 28 is fitted into the cut-out portion 25*a* of the second cam 25 while rising with the start of turning. Then, when the first rotation shaft 22 rotates counterclockwise all the way around, the pressing operation is completed.

As described above, the adhesive application is completed with respect to each of the sheets other than the uppermost sheet in a plurality of sheets mounted on the processing tray 102, which are the target of the binding. Then, the plurality of sheets are pressed toward the pressing plate 14 by the binding unit T in a state where the entirety of the plurality of sheets configuring the sheet bundle are overlapped and mounted. Here, after the adhesive application unit 101 applies the adhesive on the sheet, a portion between the adjacent sheets in the plurality of sheets is firmly adhered (crimped) by the adhesive by pressing of a pressing mechanism, and the sheet binding is completed.

Figure 8:
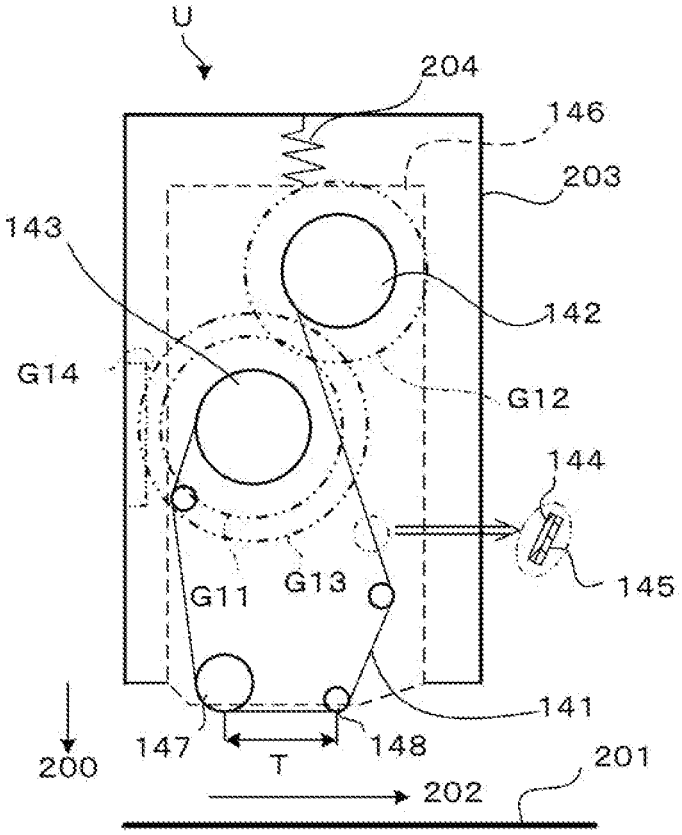
FIG. 8 is a schematic view illustrating another configuration of an adhesive applying unit.

As illustrated in FIG. 8, in the adhesive applying unit U, an adhesive tape method may be also applied.

In the adhesive applying unit U in FIG. 8, a pressure-sensitive transfer type adhesive tape (hereinafter, abbreviated as an adhesive tape) 141 is used as the adhesive. The adhesive tape 141 is wound on a feeding reel 142 in a roll shape and one end thereof is wound on a winding reel 143. An adhesive base material 145 of the adhesive tape 141 is peelably adhered to one surface of a roll film 144 through an adhesive layer. The base material 145 has a double face adhesive property and is peeled from the adhesive tape 141 in a transfer region transferred to an adhered surface.

The feeding reel 142 and the winding reel 143 are rotatably supported by a substrate 146. The adhesive tape 141 also extends around rollers 147 and 148 provided in a leading end portion of the substrate 146. A length between the roller 147 and the roller 148 is a pressing transfer region T. The substrate 146 is pressed down in an arrow direction 200. The base material 145 of the adhesive tape 141 is pressed on a transferred surface 201. Then the substrate 146 is returned upward, whereby the base material 145 of the pressing transfer region T is transferred to the transferred surface 201.

In the embodiment, the substrate 146 is disposed in an outer case 203 movably in the up-down direction. A spring member 204 biases the substrate 146 downward in the drawing with respect to the outer case 203. A first gear G11 is coaxially fixed to the winding reel 143 and a second gear G12 is coaxially fixed to the feeding reel 142. The first gear G11 and the second gear G12 are meshed with each other. Thus, when the adhesive tape 141 is drawn in a winding direction, the first gear G11 rotates counterclockwise, the winding reel 143 rotates clockwise together with the second gear G12, and the adhesive tape 141 is wound on the winding reel 143.

A third gear G13 is mounted on the winding reel 143 coaxially with the second gear G12 through a one-way clutch mechanism (not illustrated). A rack gear G14 is mounted on the inside of a case 203. The third gear G13 is meshed with the rack gear G14.

When the third gear G13 rotates clockwise, the one-way clutch connects the third gear G13 and the winding reel 143, and the winding reel 143 winds the adhesive tape 141 by the rotational force of the third gear G13.

Conversely, when the winding reel 143 rotates clockwise, the one-way clutch releases the connection of the third gear G13 and the winding reel 143, and only the winding reel 143 rotates in the winding direction.

When the substrate 146 is pressed downward by the spring force of the spring member 204 with respect to the outer case 203, the third gear G13 rotates clockwise by meshing with the rack gear G14 and winds the adhesive tape 141 onto the winding reel 143. That is, after the base material 145 is transferred, when moving the outer case 203 upward, the adhesive tape 141 is wound onto the winding reel 143 at a predetermined amount and the base material 145 is positioned in the pressing transfer region T in synchronization with the substrate 146 being pressed downward by the spring force of the spring member 204.

Meanwhile, if folding or stapling is desired to be performed with respect to the sheet passed through the punching unit 109, the sheet is guided to the transportation path 110 by the flapper 117 and the stapling by the stapler W or the folding by the folding unit B is performed with respect to the sheet discharged on a stacker 111. Specifically, for example, the folding unit B folds the sheet bundle, in which the stapling is performed by the stapler W, with a folding blade 112 and a folding roller 113. A fold mark is further sandwiched by a folding-enhancing roller 114 and then the folded sheet bundle is discharged on a third discharge tray 116 by a discharging roller 115.

Thereafter, for example, the sheet bundle formed of the plurality of sheets which are bound by the binding is discharged on a second discharge tray 105 by a discharge member (not illustrated) provided in the processing tray 102.

Next, if the total number of sheets to be printed exceeds the allowable binding number (X) of sheets in the adhesive application unit 10, it is not possible to perform appropriate adhesive application. Furthermore, there is a concern that remaining sheet exceeding the allowable binding number of sheets causes paper jam on the processing tray.

In the embodiment, the number of sheets fed to the processing tray 102 may be obtained by a sheet detection sensor 8 provided on a sheet discharge side of the image forming apparatus 7. Alternatively, the total number of sheets to be printed may be obtained by the image forming apparatus 7.

Thus, in the embodiment, if a number of remaining sheets exceeding the allowable binding number (X) of sheets are present, according to whether or not the remaining number (n) of sheets exceeds the predetermined value (N), a first mode in which the adhesive binding is performed also including the remaining sheets as a bundle and a second mode in which a user selects whether or not the adhesive application is continued. If the adhesive application is continued, the adhesive binding is performed for the remaining sheets as another sheet bundle are provided. Furthermore, if the user selects that the adhesive application is not continued, a third mode in which the adhesive binding is performed for (X) sheets as one bundle and the binding is performed for the remaining (n) sheets in a post-process different from the adhesive binding such as sorting and stapling is provided.

Figure 9:
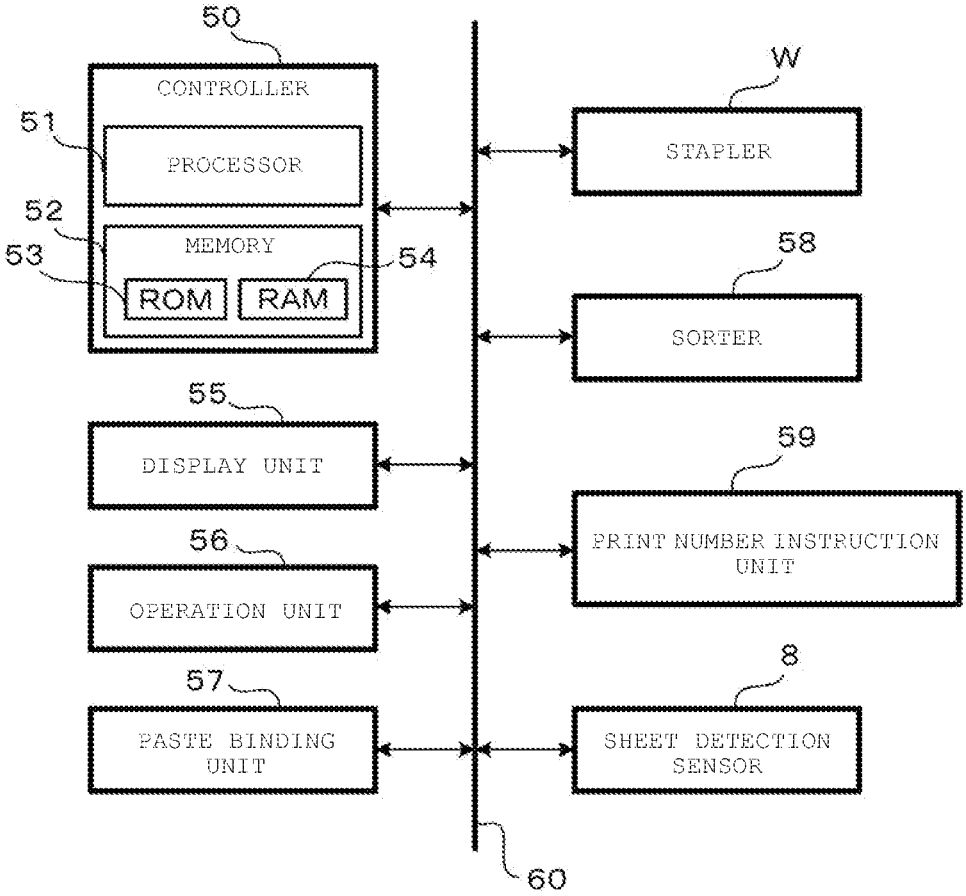
FIG. 9 is a block diagram of a control block of the post-processing apparatus.

FIG. 9 is a block diagram of a control block of the post-processing apparatus.

In FIG. 9, a controller 50, a display unit 55, an operation unit 56, a adhesive binding unit 57, the stapler W, a sorter 58, a print number instruction unit 59, the sheet discharge sensor 8, and the like are connected through a bus 60.

The controller 50 has a processor 51, which may be a Central Processing Unit (CPU) or a Micro Processing Unit (MPU), and a memory 52.

The processor 51 determines the remaining number n of sheets based on the number A of sheets instructed to be printed from the print number instruction unit 59 and the allowable binding number X of sheets from the binding unit 10. The processor 51 executes the first mode by comparing the remaining number n of sheets to the predetermined remaining number N of sheets. Furthermore, the processor 51 executes the second mode and the third mode based on operation information from the user operating the operation unit 56.

For example, the memory 52 is a semiconductor memory and has a Read Only Memory (ROM) 53 for storing various control programs and a Random Access Memory (RAM) 54 for supplying a temporal working area in the processor 51. For example, the ROM 53 stores a program determining the remaining number n of sheets based on the number A of sheets instructed to be printed and the allowable binding number X of sheets, a program executing the first mode by comparing the remaining number n of sheets to the predetermined remaining number N of sheets, and a program executing the second mode and the third mode based on the operation information of whether the operation unit 56 is continued or stopped.

Figure 10:
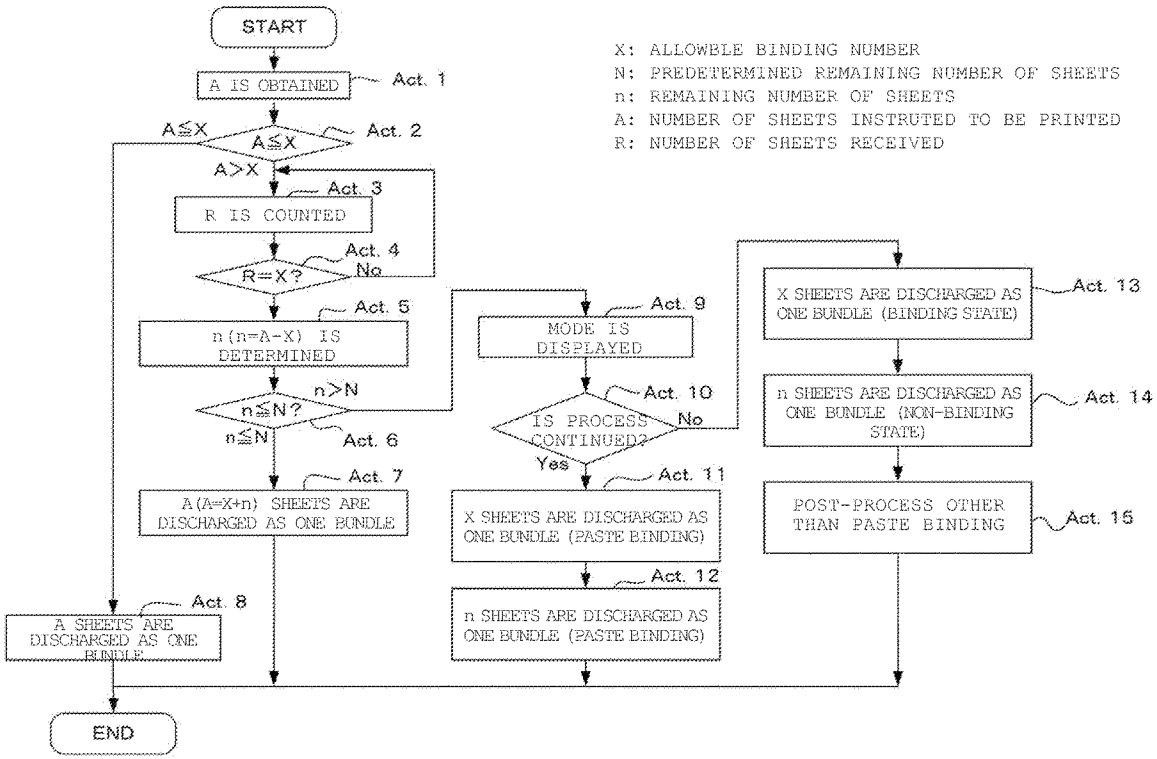
FIG. 10 is a flowchart illustrating an example sequence of operations for binding.

FIG. 10 is a flowchart illustrating an example sequence of operations for binding.

In FIG. 10, symbol A indicates the number of sheets instructed to be printed, symbol X indicates the allowable binding number of sheets which may be adhesive bound by the adhesive binding unit 10 at one time, symbol N indicates the predetermined remaining number of sheets set by the user in advance (in other words, the symbol N is a threshold value for determining whether or not A sheets are bound and discharged as one bundle), symbol n (n=A−X) indicates the remaining number of sheets exceeding the allowable binding number (X) of sheets, and symbol R indicates the number of printed sheets received by the post-processing apparatus 1 from the image forming apparatus 7. As noted, the predetermined remaining number of sheets N may be set by the user in advance, through use of a control panel on the display (not shown) or through a remote terminal such as a PC (not shown). The predetermined remaining number of sheets N may have a default value set in advance.

In Act 1, the number A of sheets instructed to be printed is obtained from the image forming apparatus and the process proceeds to Act 2.

In Act 2, the number A of sheets instructed to be printed and the allowable binding number (X) of sheets are compared. If AX, since the height of the sheets of the number A of sheets instructed to be printed is that of the allowable binding number (X) of sheets or less, the height does not reach the binding limit height h. That is, since there is no hindrance to the adhesive binding in the adhesive binding unit 10, the process proceeds to Act 8. Meanwhile, if A>X, since there is a concern that the height of the sheets of the number A of sheets instructed to be printed exceeds the binding limit height h, the process proceeds to Act 3.

In Act 8, the adhesive binding is performed for A sheets as one bundle and a main process is completed. Moreover, in the adhesive binding of the embodiment, each sheet is adhesive bound by transferring the adhesive to the sheet one by one.

In Act 3, the information of R of the number of sheets received from the image forming apparatus 7 detected by the sheet discharge sensor 8 is counted and the process proceeds to Act 4.

In Act 4, the information of R of the number of sheets received by the post-processing apparatus 1 is compared to the allowable binding number (X) of sheets. If the number of sheets fed to the adhesive binding unit 10 reaches the allowable binding number (X) of sheets, the process proceeds to Act 5.

In Act 5, thereafter, the remaining number (n) of sheets still to be received by the post-processing apparatus is determined and the process proceeds to Act 6. Here, the remaining number (n) of sheets is determined by the following expression n=A−X (or n=A−R).

In Act 6, the remaining number (n) of sheets is compared to the predetermined remaining number (N) of sheets set in advance. If n≤N, the process proceeds to Act 7 and the first mode is executed. Meanwhile, if n>N, the process proceeds to Act 9 and the second mode or the third mode is executed. That is, since the height of the sheets according to the number (A) of sheets instructed to be printed, exceeds the binding limit height h, it is not possible to perform the adhesive binding by the adhesive binding unit 10. The determination of Act 6 may be made after the number (A) of sheets to be printed has been provided and before the adhesive binding process begins.

In Act 7, since the remaining number (n) of sheets is less than N, the adhesive binding is performed for the number A of sheets instructed to be printed as one bundle and the sheets are discharged, the main process is completed. That is, even if the height of the sheets to be adhesive bound exceeds that of the allowable binding number (X) of sheets, since the height of the sheets to be adhesive bound does not reach the binding limit height h, the adhesive binding is performed as one bundle.

In Act 9, display of effect to continue is performed in the display unit 55 and the process proceeds to Act 10.

In Act 10, if the controller 50 receives a signal of a continuing process from the operation unit 56, in order to discharge the sheets by dividing into two bundles, in Act 11, the adhesive binding is performed for the number (X) of sheets as one bundle and the process proceeds to Act 12. Moreover, in the embodiment, the adhesive binding is performed for each sheet by transferring the adhesive to the sheet one by one.

In Act 12, the adhesive binding is performed for the number (n) of sheets as a second bundle and the second sheet bundle is discharged to the second discharge tray 105 and the main process is completed.

In Act 10, if the controller 50 receives a signal of process stop from the operation unit 56, the process proceeds to Act 13 and the third mode is executed.

In Act 13, the adhesive binding is performed for X sheets as one bundle, and the bundle of X sheets is discharged in a binding state. The process then proceeds to Act 14.

In Act 14, the remaining (n) sheets are discharged in a state being not bound respectively and the process proceeds to Act 15.

In Act 15, the binding is performed for the remaining (n) sheets in a post-process (for example, stapling) different from the adhesive binding and the main process is completed.

As described above, if the number of sheets discharged from the image forming apparatus 7 and received by the post-processing apparatus reaches the allowable binding number (X) of sheets of the adhesive binding unit 10 and the remaining number (n) of sheets is the predetermined remaining number (N) of sheets or less, since the height of A sheets to be bound is the binding limit height h or less, the adhesive application is performed exceeding the allowable binding number (X) of sheets and the allowable binding number (X) of sheets and the remaining number (n) of sheets are discharged as the bundle of A sheets.

Meanwhile, if the number of sheets received by the post-processing apparatus reaches the allowable binding number (X) of sheets of the adhesive binding unit 10 and the remaining number (n) of sheets exceeds the predetermined remaining number (N) of sheets, since the height of A sheets to be bound exceeds the binding limit height h, whether or not the adhesive application is continued is displayed on the operation unit and the user determines the continuation of the adhesive application.

If stop instead of continuation is determined, the user selects the binding of the remaining (n) the sheets from the sort, staple, and the like.

While certain embodiments have been described, these embodiments have been presented by way of example only, and are not intended to limit the scope of the exemplary embodiment. Indeed, the novel embodiments described herein may be embodied in a variety of other forms; furthermore, various omissions, substitutions and changes in the form of the embodiments described herein may be made without departing from the spirit of the exemplary embodiment. The accompanying claims and their equivalents are intended to cover such forms or modifications as would fall within the scope and spirit of the exemplary embodiment.

What is claimed is:

1. A post-processing apparatus comprising:

an adhesive binding unit configured to bind a plurality of sheets into a bundle by applying an adhesive between each of the plurality of sheets and thereafter pressing the bundle, each of the plurality of sheets being conveyed from an image forming apparatus;

a counter configured to count a number R of sheets currently conveyed to the post-processing apparatus from the image forming apparatus; and a controller configured to set an allowable binding number X of sheets capable of being subject to binding at one time in the adhesive binding unit, set a predetermined remaining number N of sheets, receive a number A of the sheets instructed to be bound in the adhesive binding unit, calculate a remaining number n of sheets, where $n=A-X$, determine whether $n>N$ or $n\leq N$, control the adhesive binding unit to bind the A number of the sheets into a single bundle if it is determined that $n\leq N$, and control the adhesive binding unit to bind only the first X number of sheets into a single bundle if it is determined that $n>N$ and the number R of sheets counted by the counter is $R=X$.

2. The apparatus according to claim 1, wherein, when it is determined that $n>N$ and $R>X$, the controller controls the adhesive binding unit to process the remaining number n of sheets according to a processing indicated by a received user instruction.

3. The apparatus according to claim 2, wherein the processing indicated by the received user instruction is selected from a display that displays a selectable first mode in which the remaining number of sheets counted by the counter when $R>X$ is processed by binding as another single bundle in the adhesive binding unit and a selectable second mode in which the remaining number sheets counted by the counter when $R>X$ is processed according to another processing that is not binding in the adhesive binding unit.

4. The apparatus according to claim 3, further comprising:

a second binding unit that performs a second binding process different from the adhesive binding performed in the adhesive binding unit, wherein, if the second mode is selected when $R>X$, the controller controls the second binding unit to perform the second binding process on the remaining number n of sheets.

5. The apparatus according to claim 3, wherein the another processing is one of sorting and stapling.

6. The apparatus according to claim 1, wherein the adhesive binding unit applies an adhesive tape between each of the plurality of sheets.

7. The apparatus according to claim 1, wherein the adhesive binding unit applies a liquid adhesive between each of the plurality of sheets.

8. The apparatus according to claim 1, further comprising a punching unit configured to punch at least one hole in each the plurality of sheets conveyed from the image forming apparatus.

9. The apparatus according to claim 1, wherein the adhesive binding unit includes a pressing plate and a bottom plate configured to press the bundle therebetween, and N is set based on a thickness of each sheet and a distance between the pressing plate and the bottom plate.

10. A post-processing method comprising the steps of:

in a post-processing apparatus, receiving from an image forming apparatus a number A of the sheets instructed to be bound in an adhesive binding unit that is configured to bind a plurality of sheets into a bundle by applying an adhesive between each of the plurality of sheets and thereafter pressing the bundle;

counting a number R of sheets currently conveyed to the post-processing apparatus from the image forming apparatus setting an allowable binding number X of sheets capable of being subject to binding at one time in the adhesive binding unit;

setting a predetermined remaining number N of sheets;

calculating a remaining number n of sheets, where n=A−X;

determining whether n>N or n≤N;

binding the A number of the sheets into a single bundle in the adhesive binding unit if it is determined that n≤N;

binding only the first X number of sheets into a single bundle if it is determined that n>N and the number R of sheets counted is R=X.

11. The method according to claim 10, wherein, if it is determined that n>N and R>X, the remaining number n of sheets are processed according to a processing indicated by a received user instruction.

12. The method according to claim 11, wherein the processing indicated by the received user instruction is selected from a display that displays a selectable first mode in which the counted remaining number of sheets when R>X is processed by binding as another single bundle in the adhesive binding unit and a selectable second mode in which the remaining number sheets counted by the counter when R>X is processed according to another processing that is not binding in the adhesive binding unit.

13. The method according to claim 12, further comprising the step of:

performing, in a second binding unit, a second binding process different from the adhesive binding performed in the adhesive binding unit on the remaining number n of sheets when the second mode is selected and R>X.

14. The method according to claim 12, wherein the another processing is one of sorting and stapling.

15. The method according to claim 10, wherein the adhesive binding unit applies an adhesive tape between each of the plurality of sheets.

16. The method according to claim 10, wherein the adhesive binding unit applies a liquid adhesive between each of the plurality of sheets.

17. The method according to claim 10, further comprising the step of:

punching at least one hole in each the plurality of sheets conveyed from the image forming apparatus.

18. The method according to claim 10, wherein the adhesive binding unit includes a pressing plate and a bottom plate configured to press the bundle therebetween, and N is set based on a thickness of each sheet and a distance between the pressing plate and the bottom plate.

* * * * *